US007441939B2

(12) United States Patent
Scholeno et al.

(10) Patent No.: US 7,441,939 B2
(45) Date of Patent: Oct. 28, 2008

(54) FRONT OR REAR LOADING SOCKET SYSTEM

(75) Inventors: Michael F. Scholeno, York, PA (US); Shane Brown, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/583,471

(22) Filed: Oct. 19, 2006

(65) Prior Publication Data

US 2008/0096428 A1 Apr. 24, 2008

(51) Int. Cl.
*F21S 4/00* (2006.01)

(52) U.S. Cl. ..... 362/652; 362/225; 362/296

(58) Field of Classification Search ..... 362/296, 362/225; 439/244
See application file for complete search history.

(56) References Cited

U.S. PATENT DOCUMENTS 5,924,882 A * 7/1999 Slazakowski ..... 439/244
6,162,079 A * 12/2000 Slazakowski ..... 439/244
7,080,923 B2 * 7/2006 Plunk et al. ..... 362/225
2004/0032738 A1 * 2/2004 Harnischmacher ..... 362/296

* cited by examiner

*Primary Examiner*—Anabel M Ton
(74) *Attorney, Agent, or Firm*—William H. McNeill

(57) ABSTRACT

A lamp socket (10) comprises a housing (12) having a longitudinal axis (14) and first and second planar surfaces, (16, 18), respectively, spaced apart along the longitudinal axis (14), and orthogonal thereto. Aa central, lamp receiving opening (20) is coaxially aligned with the longitudinal axis 14 and mounting means 21 are formed with the first planar surface for accepting, and electrically connecting a lamp, and maintenance means 21*a* are formed with the second planar surface for maintaining the lamp within the socket. The mounting means (21) includes a first pair of lamp contacts (22, 24) positioned in a first pair of cavities (22', 24') formed in the first planar surface (16). The maintenance means (21*a*) include first lamp base receivers (30) and second lamp base receivers (32) formed in the second planar surface (18); and first and second lamp base retainers (38, 40), respectively, associated with the second planar surface (18).

1 Claim, 7 Drawing Sheets

FRONT OR REAR LOADING SOCKET SYSTEM

TECHNICAL FIELD

This invention relates to lamp sockets and more particularly to lamp sockets that can accept lamps from a front or rear loading position.

BACKGROUND ART

Lamp fixture manufacturers design fixtures for high power lamps to accept lamps from either a front or rear position. Such designs require a number of different sockets to accept specifically designed lamps. Naturally, this requires manufacturers to keep an inventory of multiple sockets; an expensive and cumbersome approach to fixture design. It would, therefore, be an advance in the art if a single socket could be provided that would accept multiple lamps and that could be positioned to accept lamps from either a forward loading or rear loading fixture.

DISCLOSURE OF INVENTION

It is, therefore, an object of the invention to obviate the disadvantages of the prior art.

It is another object of the invention to enhance lamp sockets.

Yet another object of the invention is the provision of a lamp socket that can accept multiple lamps from a variety of positions.

These object are accomplished, in one aspect of the invention, by a lamp socket comprising: a housing having a longitudinal axis and first and second planar surfaces spaced apart along the longitudinal axis and orthogonal thereto; a central, lamp receiving opening coaxially aligned with the longitudinal axis; and mounting means formed with the first planar surface for accepting, and electrically connecting a lamp and means formed with the second planar surface for maintaining the lamp within the socket. The socket will accept a lamp from a forward position or a rear entry position and is thus useable in multiple fixtures.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
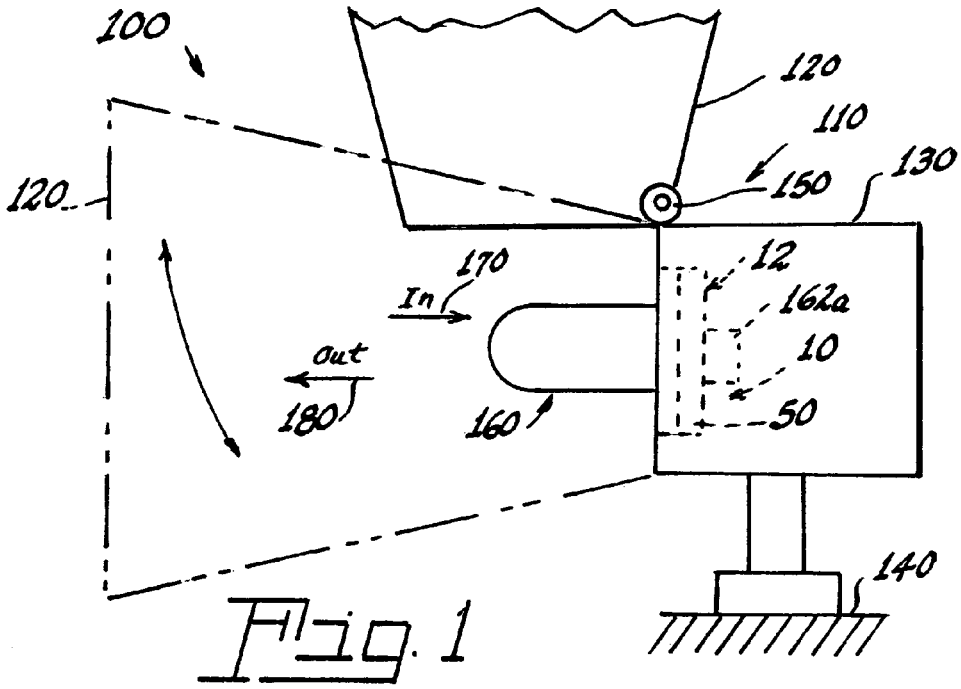
FIG. 1 is a diagrammatic view of a front-loading fixture.

Referring now to the drawings with greater particularity, there is shown in FIG. 1 a front-loading fixture 100 having a housing 110 that includes a front portion 120 and a rear portion 130. The rear portion 130 can be fixed to a support 140 and the front portion 120 can be opened via a hinge 150 to gain access to a lamp 160 that is inserted into socket 10. The lamp 160 is inserted and removed from the socket 10 in the directions indicated by the arrows 170, 180.

Figure 2:
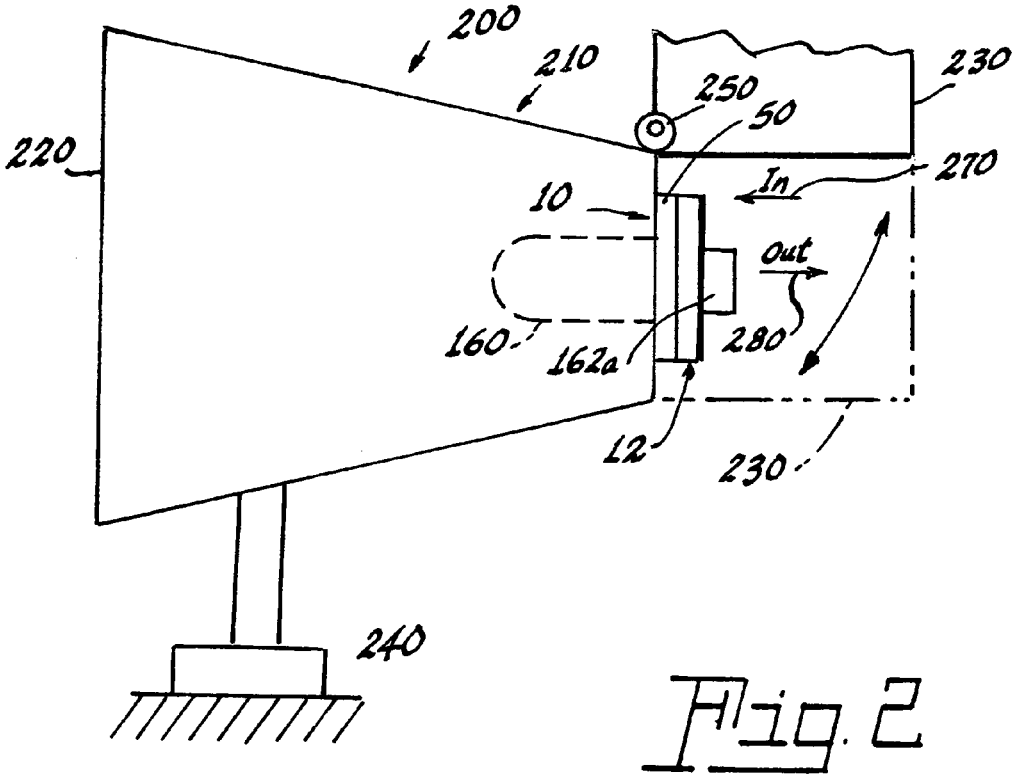
FIG. 2 is a diagrammatic view of a rear-loading fixture.

A rear-loading fixture 200 is depicted in FIG. 2 wherein the fixture 200 has a housing 210 with a front portion 220 and a rear portion 230. In this instance it is the front portion 220 that is fixed to a support 240 and the rear portion 230 that can be opened via a hinge 250 to gain access to a lamp 160 that is inserted into socket 10. The lamp 160 for fixture 200 is inserted and removed from the rear as indicated by the arrows 270, 280.

Figures 3, 4, 5:
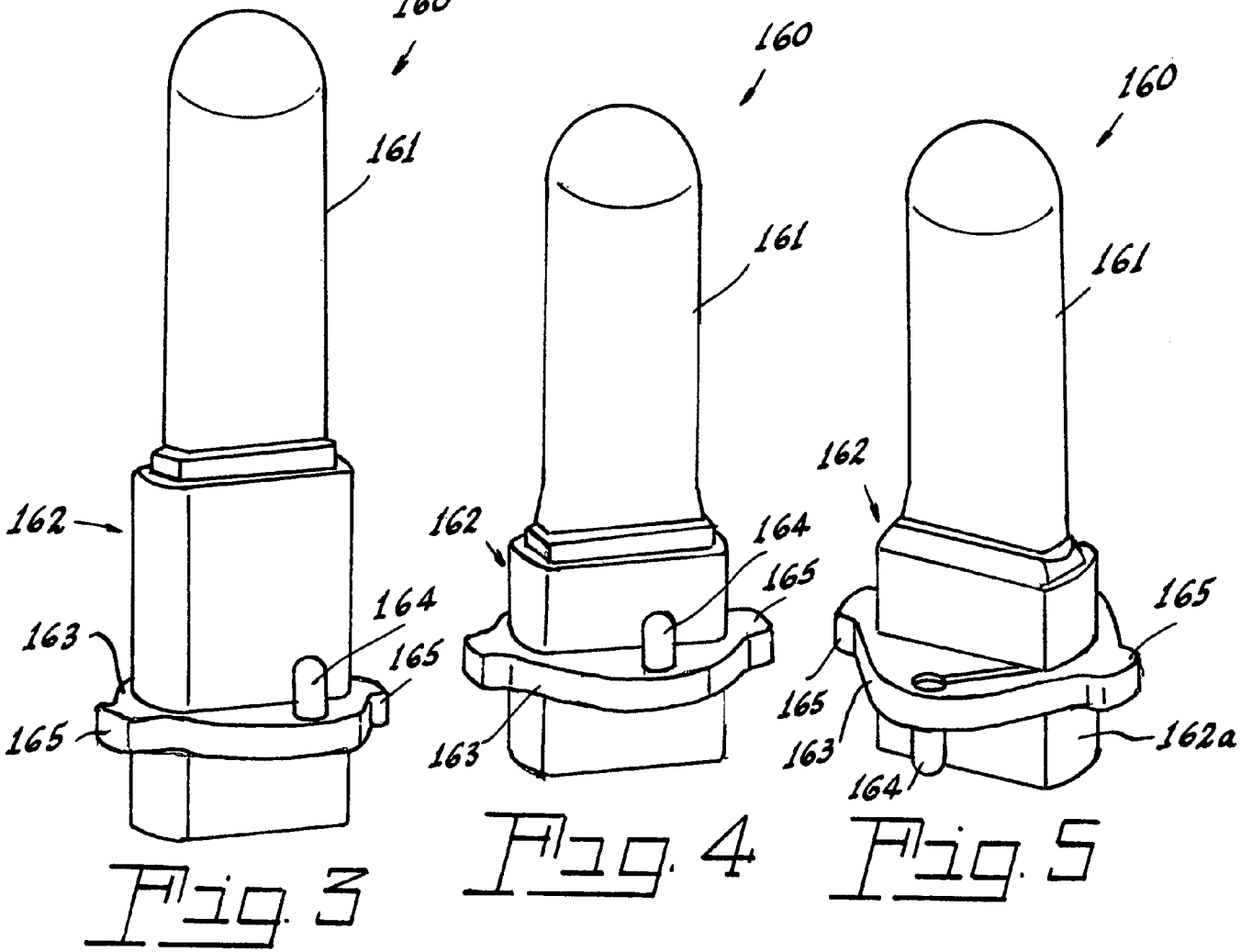
FIGS. 3-5 are perspective views of lamps useable with an embodiment of the invention.

Referring to FIGS. 3-5, lamps 160 comprise a lamp capsule 161 having a reversible base 162 of a suitable material, such as a high temperature ceramic or plastic. The base 162 includes a flange 163 with a pair of lamp contacts 164 oppositely disposed thereon and projecting therefrom. Lamp retainers 165 are formed with the flange 163 and are orthogonal to the lamp contacts 164. The bases 162 can have a long body, as is shown in FIG. 3 or a short body, as shown in FIGS. 4 and 5 to accommodate various types of lamp capsules such as tungsten halogen capsules or arc discharge capsules of varying focal length.

The lamps 160, shown in FIGS. 3 and 4, have the lamp contacts 164 facing forward, that is, towards the lamp capsule, and these lamps are used with fixtures 200, where the lamps are inserted from the rear of the fixture.

The lamp 160, shown in FIG. 5, has the lamp contacts 164 facing rearward, that is, away from the lamp capsule and these lamps are employed with fixtures 100, where the lamp would be inserted from the front of the fixture.

The subject of this invention, a lamp socket 10 that is useable with either type of lamp or either type of fixture, is described below.

Figure 6:
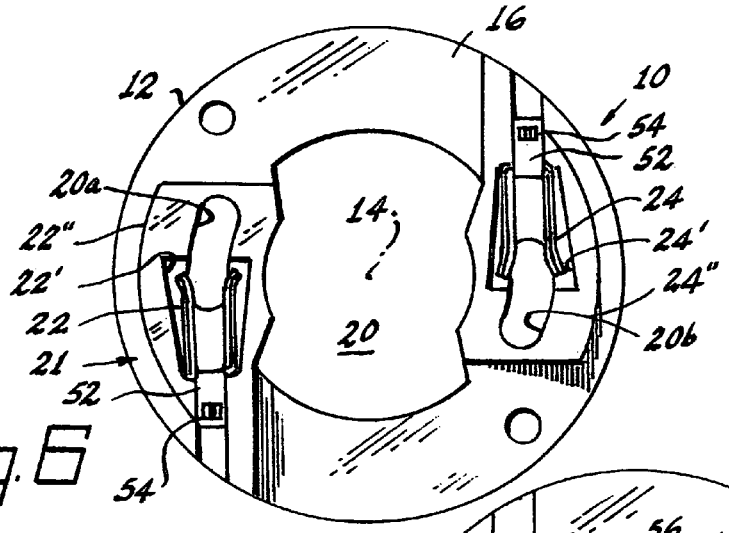
FIG. 6 is a plan view of a first planar surface of a socket employing an embodiment of the invention.
Figure 7:
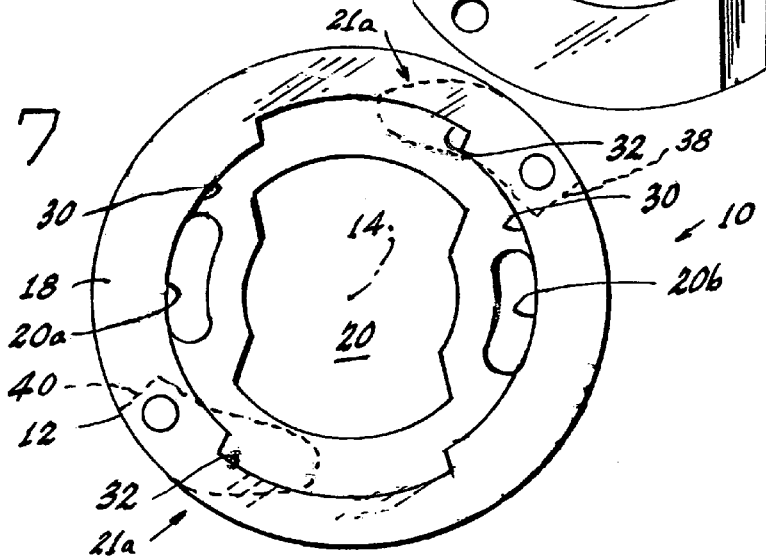
FIG. 7 is a plan view of a second planar surface of a socket employing an embodiment of the invention.

Referring now to FIGS. 6 and 7, there is shown a lamp socket 10 having a housing 12 with a longitudinal axis 14 and first and second planar surfaces 16, 18, respectively, spaced along the longitudinal axis 14 and orthogonal thereto. A central, lamp receiving opening 20 is coaxially aligned with the longitudinal axis 14. Mounting means 21 are formed with the first planar surface 16 for accepting and electrically connecting a lamp, and means 21*a* are formed with the second planar surface 18 for maintaining a lamp within the socket 10.

More specifically, in one embodiment of the invention, the mounting means 21 comprises arcuate openings 20*a* and 20*b* that lead, respectively, into lamp contact engagers 22, 24 that are positioned in a first pair of cavities 22', 24'. The cavities can be formed directly in the first planar surface 16; preferably, the cavities are formed in bosses 22", 24" that are raised slightly above the surface 16, for reasons that will become apparent.

Figure 10:
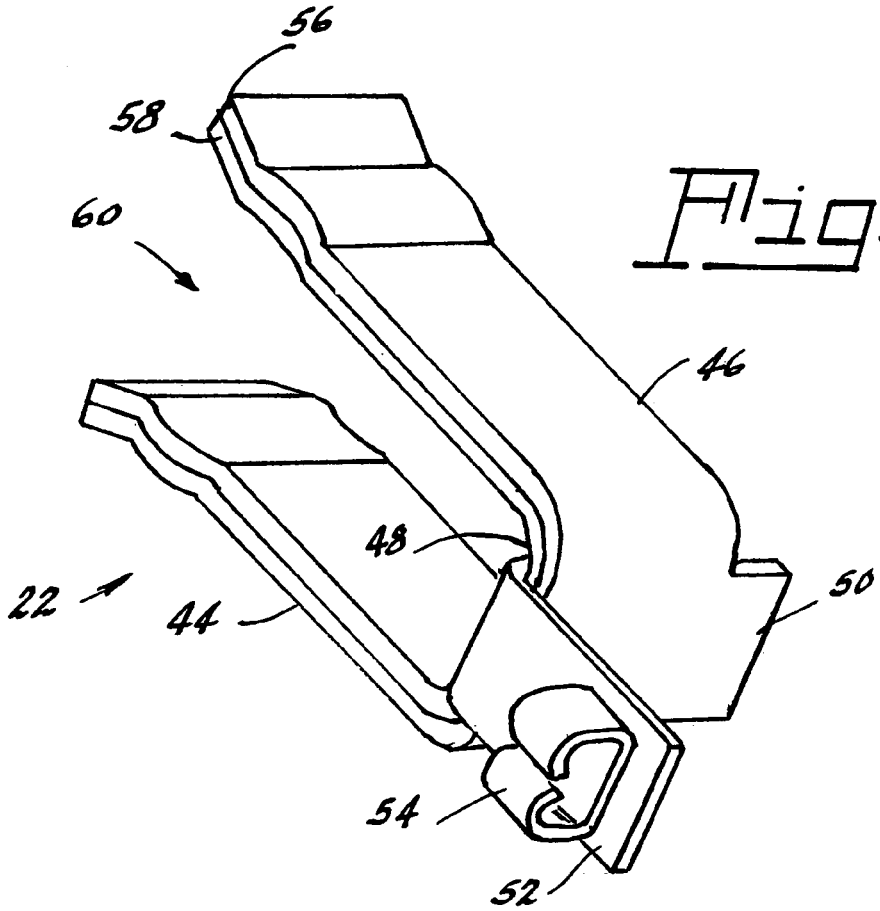
FIG. 10 is a perspective view of a spring useable with the invention.

The lamp contact engagers 22, 24, one of which, for example contact engager 22, is shown in FIG. 10, each comprise a U-shaped member 42 having legs 44, 46 and a bight 48. A first tab 50 extends from the bight 48 in a direction parallel to the bight 48 and a second tab 52 extends from the bight 48 in a direction orthogonal to the bight. The tab 50 extends into a slot, not shown, formed in the bottom of the cavities 22', 24', to properly position the contacts. A wire connector is 54 formed with the second tab 52 for connecting the lamp to an outside power source. In a preferred embodiment of the invention, the lamp contact engagers 22, 24 are springs having an inner material 56, for example, of nickel to provide a good electrical connection and an outer material 58, for example, of steel to provide the required normal force. Preferably, the entrance 60 of the lamp contact engagers is formed as shown to provide a tactile feel when the bulb is being loaded to allow the operator to know that the bulb is fully inserted. Springs comprised of dual materials are shown in U.S. Pat. No. 7,059,888, issued Jun. 13, 2006 and assigned to the assignee of the instant invention.

Referring now to FIG. 7, first lamp base receivers 30 and second lamp base receivers 32 in the form of arcuate cutouts are formed in the second planar surface 18. The first lamp base receivers 30 receive the portion of flange 163 containing the lamp contacts 164 and the second lamp base receivers 32, which have a larger diameter, receive the lamp retainers 165. First and second lamp base retainer holders 38, 40, respectively, are associated with the second planar surface 18. The lamp base retainer holders 38, 40, can take the form of extended arms that overlie the second lamp base receivers 32 and hold the lamp 160 in position after the lamp 160 has been inserted into the socket 10 and rotated from a first position to a second and locked position, which, in the latter, comprises the lamp retainers 165 being positioned under the lamp retainer holders 38, 40.

Figure 11:
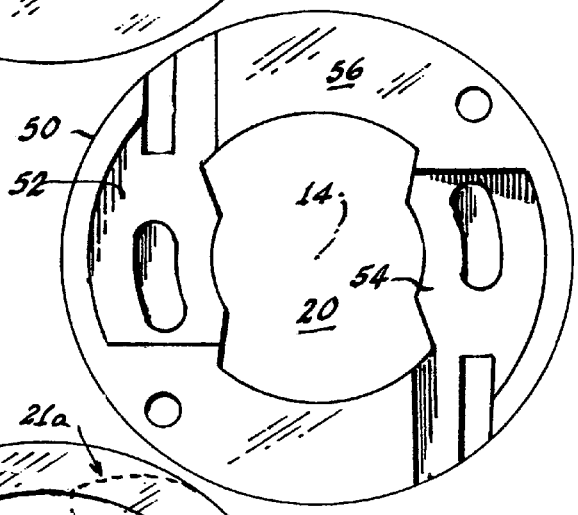
FIG. 11 is a plan view of a cover used with an embodiment of the invention.

FIG. 11 illustrates a cover member 50 that is mounted to the first planar surface 16 and functions to hold the lamp contact engagers 22, 24 in the proper location. Preferably, depressions 52, 54 are formed in the surface 56 of the cover 50 to receive the bosses 22" and 24" formed on the planar surface 16. this feature creates an increased air path to the lamp contact engagers 22, 24.

Figure 8:
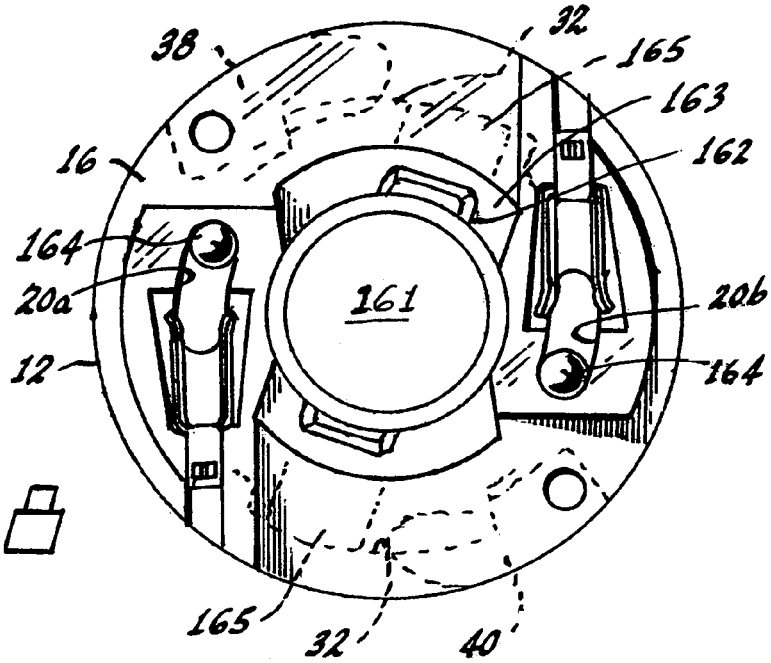
FIGS. 8 and 9 illustrate steps in the insertion of a lamp in a socket.
Figure 9:
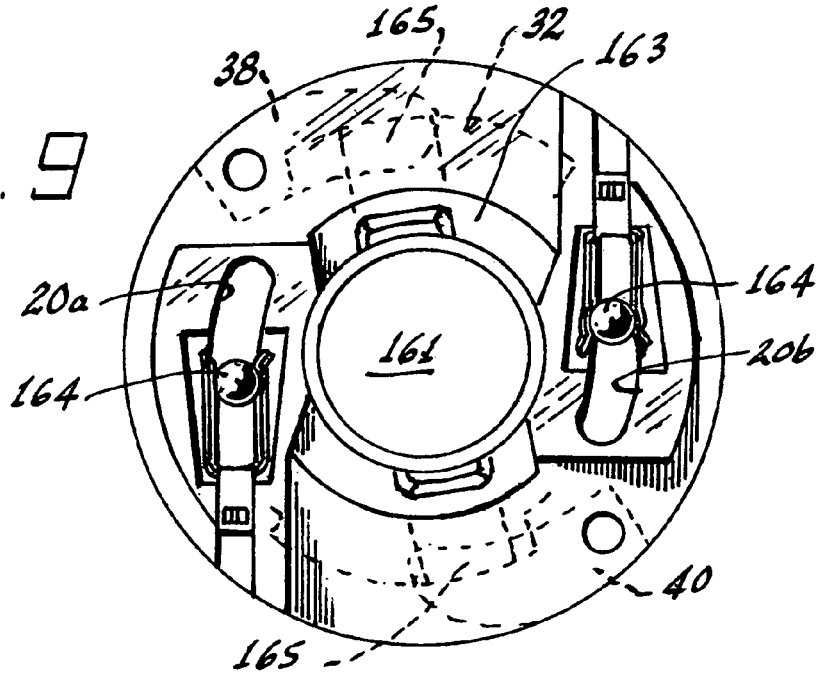
Figure 12:
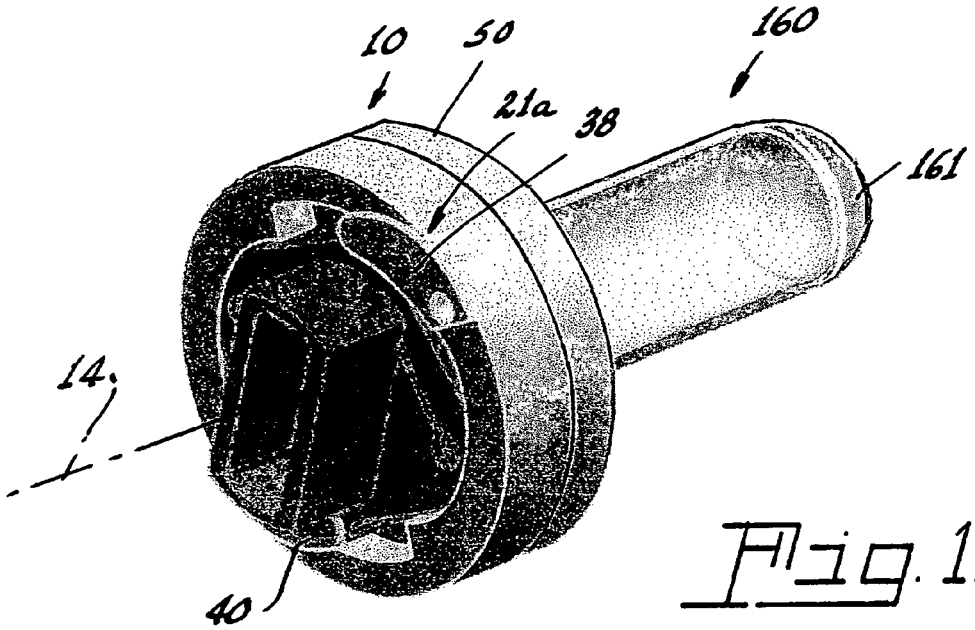
FIG. 12 is a perspective view of a lamp and socket according to an embodiment of the invention.

FIGS. 8 and 9 illustrate the initial loading position of a lamp 160 and the locked position of the lamp 160, respectively, with a socket 10 provided for rear loading of the lamp. As can be seen from a review of the illustrations, the lamp capsule 161 is inserted through the central lamp receiving opening 20 until the lamp contacts 164 penetrate the arcuate openings 20*a* and 20*b*. With the lamp 160 fully inserted, the lamp 160 is rotated until the lamp contacts 164 engage the lamp contact engagers 22, 24. At that point the lamp retainers 165 will be positioned under the lamp retainer holders 38, 40 and the lamp will be available for operation. A perspective view of a lamp 160 loaded from the rear is shown in FIG. 12.

Figure 13:
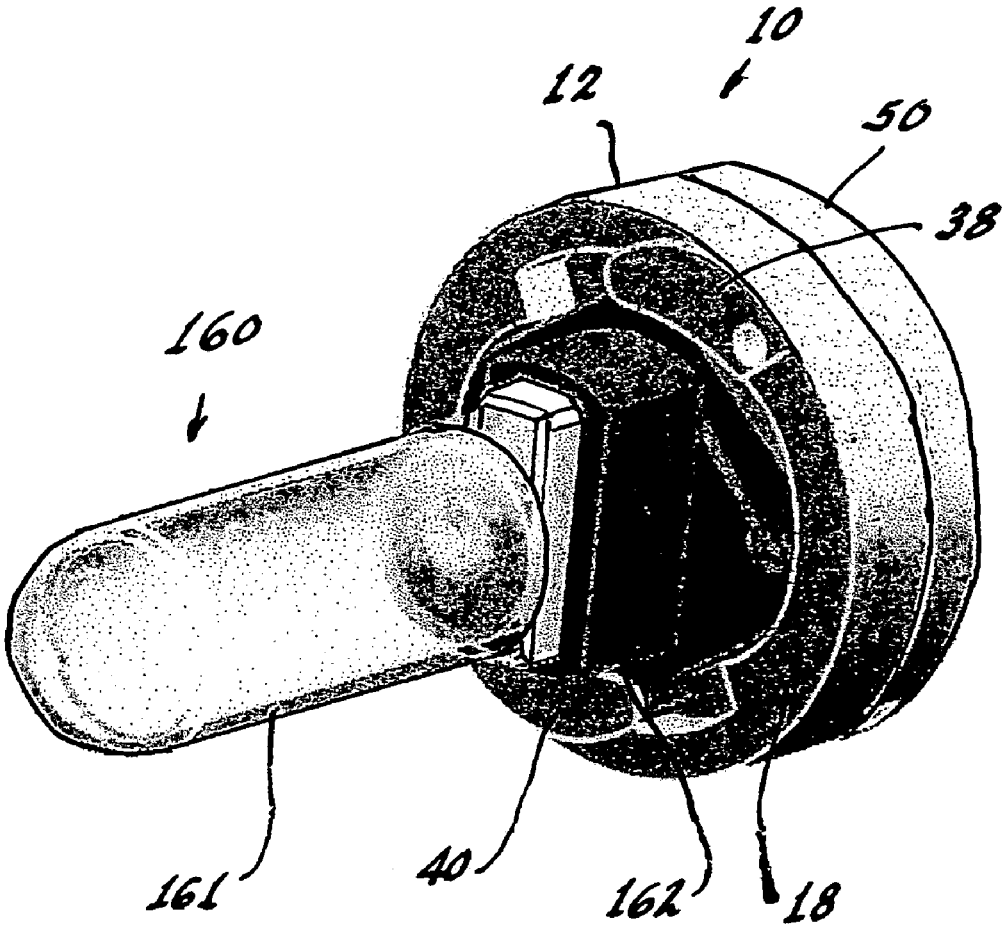
FIG. 13 is perspective view of a lamp and socket according to another embodiment of the invention.

FIG. 13 provides a perspective view of a lamp 160 when the socket 10 is utilized as a front loading socket. As will be seen from the figure, when utilized as a front loading socket it is the lower portion 162*a* of the base 162 (see FIGS. 1 and 5) that is inserted into the central lamp opening 20.

Thus there is provided a lamp socket that can function as both a front loading and a rear loading socket, greatly reducing the inventory requirements of fixture manufacturers. The socket can accept tungsten-halogen lamps as well as arc discharge lamps and, additionally, can receive lamps with a wide variance in focal length.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A front or rear loading lamp socket, said socket comprising:

a longitudinal axis and first and second planar surfaces, respectively, spaced apart along said longitudinal axis and orthogonal thereto;

a central, lamp receiving opening coaxially aligned with said longitudinal axis and extending through said first and second planar surfaces;

mounting means formed with said first planar surface for accepting, and electrically connecting a lamp, and maintenance means formed with said second planar surface for maintaining said lamp within said socket, said mounting means comprising:

a first pair of lamp contacts positioned in a first pair of cavities formed in said first planar surface; each of said lamp contacts comprising:

a U-shaped member having legs and a bight;

a first tab extending from said bight in a direction parallel to said bight; and a second tab extending from said bight in a direction orthogonal to said bight;

a wire connector formed with said second tab; and first lamp base receivers and second lamp base receivers formed in said second planar surface; and first and second lamp base retainers associated with said second planar surface.

* * * * *